US009855638B2

(12) United States Patent
Nagai et al.

(10) Patent No.: US 9,855,638 B2
(45) Date of Patent: Jan. 2, 2018

(54) DRESSING APPARATUS, POLISHING APPARATUS HAVING THE DRESSING APPARATUS, AND POLISHING METHOD

(71) Applicant: Ebara Corporation, Tokyo (JP)

(72) Inventors: Satoshi Nagai, Tokyo (JP); Suguru Ogura, Tokyo (JP); Kaoru Hamaura, Tokyo (JP)

(73) Assignee: Ebara Corporation, Tokyo (JP)

( * ) Notice: Subject to any disclaimer, the term of this patent is extended or adjusted under 35 U.S.C. 154(b) by 679 days.

(21) Appl. No.: 14/274,231

(22) Filed: May 9, 2014

(65) Prior Publication Data

US 2014/0349552 A1 Nov. 27, 2014

(30) Foreign Application Priority Data

May 15, 2013 (JP) ..... 2013-102970

(51) Int. Cl.
*B24B 53/017* (2012.01)
*B24B 53/00* (2006.01)

(52) U.S. Cl.
CPC ..... *B24B 53/017* (2013.01); *B24B 53/005* (2013.01)

(58) Field of Classification Search
CPC ..... B24B 47/25; B24B 49/18; B24B 49/186; B24B 53/005; B24B 53/017
USPC ..... 451/21, 56, 72, 443
See application file for complete search history.

(56) References Cited

U.S. PATENT DOCUMENTS 5,738,568 A * 4/1998 Jurjevic ..... B24B 37/30 451/287
5,916,009 A * 6/1999 Izumi ..... B24B 37/04 257/E21.237
6,077,385 A * 6/2000 Kimura ..... B24B 37/30 156/345.14
6,196,903 B1 * 3/2001 Kimura ..... B24B 37/30 451/285
6,217,411 B1 * 4/2001 Hiyama ..... B24B 37/005 451/24
6,220,945 B1 * 4/2001 Hirokawa ..... B24B 7/228 451/287
6,322,434 B1 * 11/2001 Satoh ..... B24B 37/005 451/443

(Continued)

FOREIGN PATENT DOCUMENTS

JP H10-315118 A 12/1998
JP 2000-052233 2/2000

(Continued)

*Primary Examiner* — Monica Carter
*Assistant Examiner* — Marcel Dion
(74) *Attorney, Agent, or Firm* — Leydig, Voit & Mayer, Ltd.

(57) ABSTRACT

A dressing apparatus capable of bringing an overall dressing surface of a dresser into uniform sliding contact with a polishing surface of a polishing pad and capable of uniformly dressing the overall polishing surface of the polishing pad is disclosed. The dressing apparatus includes a dresser configured to rub against a polishing surface to dress the polishing surface that is used for polishing a substrate, a dresser shaft that applies a load to the dresser, at least one load-applying device configured to apply a downward load to a part of a peripheral portion of the dresser, and an operation controller configured to control operation of the load-applying device.

21 Claims, 17 Drawing Sheets

(56) References Cited

U.S. PATENT DOCUMENTS

| | | | | |
|---|---|---|---|---|
| 6,616,513 | B1 * | 9/2003 | Osterheld | B24B 37/26 451/287 |
| 7,004,825 | B1 * | 2/2006 | Taylor | B24B 21/04 451/443 |
| 2001/0006870 | A1 * | 7/2001 | Moore | B24B 49/006 451/5 |
| 2002/0164932 | A1 * | 11/2002 | Kamimura | B24B 29/005 451/56 |
| 2003/0166383 | A1 * | 9/2003 | Kimura | B24B 53/017 451/56 |
| 2004/0038623 | A1 * | 2/2004 | Chandrasekaran | B24B 37/013 451/5 |
| 2005/0032467 | A1 * | 2/2005 | Hoshino | B24B 53/017 451/56 |
| 2005/0282477 | A1 * | 12/2005 | Butterfield | B24B 53/12 451/443 |
| 2006/0025054 | A1 * | 2/2006 | Mayes | B24B 53/12 451/36 |
| 2010/0035525 | A1 * | 2/2010 | Deshpande | B24B 37/005 451/56 |
| 2013/0324012 | A1 | 12/2013 | Fukushima et al. | |

FOREIGN PATENT DOCUMENTS

| | | |
|---|---|---|
| JP | 2000-263416 | 9/2000 |
| JP | 2001-162513 A | 6/2001 |
| JP | 2006-175534 | 7/2006 |
| JP | 2008-087081 A | 4/2008 |

* cited by examiner

FIG. 8

| PAD REGION | DRESSER ROTATIONAL SPEED | DRESSING LOAD | LOCAL LOAD FROM LOAD-APPLYING DEVICE | ROTATIONAL ANGLE OF LOAD-APPLYING DEVICE |
|---|---|---|---|---|
| R1 | ○○$min^{-1}$ | ○○N | ○○N | ○○° |
| R2 | △△$min^{-1}$ | △△N | △△N | △△° |
| R3 | □□$min^{-1}$ | □□N | □□N | □□° |
| R4 | ◇◇$min^{-1}$ | ◇◇N | ◇◇N | ◇◇° |
| R5 | ●●$min^{-1}$ | ●●N | ●●N | ●●° |

DRESSING APPARATUS, POLISHING APPARATUS HAVING THE DRESSING APPARATUS, AND POLISHING METHOD

CROSS REFERENCE TO RELATED APPLICATION

This document claims priority to Japanese Patent Application Number 2013-102970 filed May 15, 2013, the entire contents of which are hereby incorporated by reference.

BACKGROUND

Chemical mechanical polishing (CMP) apparatus is widely known as a polishing apparatus for polishing a surface of a substrate, such as a wafer. This polishing apparatus polishes the substrate by holding the substrate with a top ring and pressing the substrate against a polishing pad on a polishing table while moving the polishing table and the top ring relative to each other. During polishing of the substrate, the polishing pad is supplied with a polishing liquid (or slurry) from a polishing liquid supply nozzle, so that the surface of the substrate is polished by a chemical action of the polishing liquid and a mechanical action of abrasive grains that are contained in the polishing liquid.

As the substrate is continuously polished with use of the polishing pad, minute irregularities that constitute the surface of the polishing pad are flattened, thus causing a decrease in a polishing rate. It has been customary to dress (or condition) the surface of the polishing pad with a dresser (or a pad conditioner) having a number of abrasive grains, such as diamond particles, electrodeposited thereon in order to recreate the minute irregularities of the polishing pad surface. During dressing of the polishing pad, a dressing liquid, such as pure water, is supplied onto the polishing pad.

FIG. 1 is a side view of a dresser 2 when dressing a polishing pad 3 on a polishing table 1. FIG. 2 is a plan view showing relative movement between the polishing table 1 and the dresser 2. The polishing pad 3 is mounted to the polishing table 1 and has an upper surface serving as a polishing surface 3*a*. In FIG. 2, dot-and-dash lines indicate oscillation of the dresser 2, and two-dot-and-dash lines indicate a plurality of regions defined on the polishing surface 3*a* of the polishing pad 3. As shown in FIG. 1, the dresser 2 is supported by a dresser arm 6. The dresser arm 6 is configured to pivot on a dresser pivot shaft 5. When the dresser arm 6 pivots, the dresser 2 oscillates on the polishing surface 3*a* in substantially a radial direction of the polishing surface 3*a*. The dresser 2 has a lower surface serving as a dressing surface constituted by a number of abrasive grains, such as diamond particles. While oscillating on the polishing surface 3*a*, the dresser 2 rotates on the polishing surface 3*a* to scrape away the polishing pad 3 slightly, thereby dressing the polishing surface 3*a*.

The dresser 2 is coupled to a dresser shaft 4 via a spherical bearing, not shown in the drawing. The dresser shaft 4 is configured to apply a load to the center of the dresser 2 to press the dressing surface of the dress 2 against the polishing surface 3*a* of the polishing pad 3. Therefore, when the dressing surface of the dresser 2 is placed in sliding contact with the polishing surface 3*a* by the rotations of the polishing table 1 and the dresser 2, the dresser 2 is tilted with respect to the polishing surface 3*a* of the polishing pad 3 due to frictional resistance that is generated between the polishing surface 3*a* and the dresser 2. If the tilted dresser 2 dresses the polishing surface 3*a* of the polishing pad 3, a peripheral portion of the dresser 2 is worn more quickly than the central portion of the dresser 2. As a result, the dresser 2 has to be replaced with a new one even before the central portion of the dresser 2 is worn. Therefore, a replacement frequency of the dresser 2 increases.

In the example shown in FIG. 2, a plurality of concentric annular or circular regions R1 through R5 are defined on the polishing surface 3*a* of the polishing pad 3. For example, the region R5 is an outermost circumferential region of the polishing pad 3, and the region R1 is a central region of the polishing pad 3. Since these regions R1 through R5 have different radii, a velocity of the polishing pad 3 in its circumferential direction varies from region to region. When the dresser 2 moves across the multiple regions R1 through R5 of the polishing pad 3, the dresser 2 is tilted in various ways due to the different velocities in the respective regions. As a consequence, the dresser 2 cannot uniformly dress the polishing surface 3*a* in its entirety, failing to make the polishing surface 3*a* flat.

SUMMARY OF THE INVENTION

It is an object to provide a dressing apparatus capable of keeping an entire dressing surface of a dresser in uniform sliding contact with a polishing surface of a polishing pad, and capable of uniformly dressing the polishing surface of the polishing pad in its entirety. It is also an object to provide a polishing apparatus having such a dressing apparatus.

Embodiments, which will be described below, relate to a dressing apparatus for dressing a surface of a polishing pad, a polishing apparatus for polishing a substrate, such as a wafer, and a polishing method.

To achieve the above objects, in an embodiment, there is provided a dressing apparatus, comprising: a dresser configured to rub against a polishing surface to dress the polishing surface that is used for polishing a substrate; a dresser shaft that applies a load to the dresser; at least one load-applying device configured to apply a downward load to a part of a peripheral portion of the dresser; and an operation controller configured to control operation of the load-applying device.

In an embodiment, the operation controller is configured to control the operation of the load-applying device so as to change the downward load in accordance with a position of the dresser on the polishing surface.

In an embodiment, the dressing apparatus further comprises a relatively moving mechanism configured to move the load-applying device relative to the dresser.

In an embodiment, the operation controller is configured to control operation of the relatively moving mechanism so as to change a position of the load-applying device relative to the dresser in accordance with a position of the dresser on the polishing surface.

In an embodiment, the relatively moving mechanism comprises a rotating mechanism configured to rotate the load-applying device around the dresser shaft.

In an embodiment, the dressing apparatus further comprises at least one position sensor configured to measure a height of the dresser, wherein the operation controller is configured to control operation of the load-applying device such that a measured value of the height of the dresser is maintained at a predetermined target value.

In an embodiment, there is provided a polishing apparatus for polishing a substrate by bringing the substrate into sliding contact with a polishing surface, the polishing apparatus comprising: a top ring configured to press the substrate against the polishing surface; and a dressing apparatus described above.

In an embodiment, there is provided a polishing method, comprising: rubbing a dresser against a polishing surface while causing the dresser to oscillate on the polishing surface to dress the polishing surface; during dressing of the polishing surface, changing a downward load applied to a part of a peripheral portion of the dresser and changing a position of the downward load in accordance with a position of the dresser on the polishing surface, thereby regulating an angle at which a dressing surface of the dresser is tilted with respect to the polishing surface; and after dressing of the polishing surface is terminated, pressing a substrate against the polishing surface to provide sliding contact between the substrate and the polishing surface, thereby polishing the substrate.

In an embodiment, dressing of the polishing surface is performed while keeping the dressing surface parallel to the polishing surface.

In an embodiment, dressing of the polishing surface is performed while measuring a height of the dresser and changing the downward load and the position of the downward load such that a measured value of the height of the dresser is maintained at a predetermined target value.

According to the above-described embodiments, the load-applying device applies the downward load to a part of the peripheral portion of the dresser to thereby keep the dressing surface of the dresser parallel to the polishing surface of the polishing pad. Therefore, the entire dressing surface of the dresser can be placed in uniform sliding contact with the polishing surface of the polishing pad, thus uniformly dressing the polishing surface of the polishing pad in its entirety.

BRIEF DESCRIPTION OF THE DRAWINGS

FIG. 8 is a diagram showing an example of a dressing recipe;

DETAILED DESCRIPTION OF EMBODIMENTS

Figure 1:
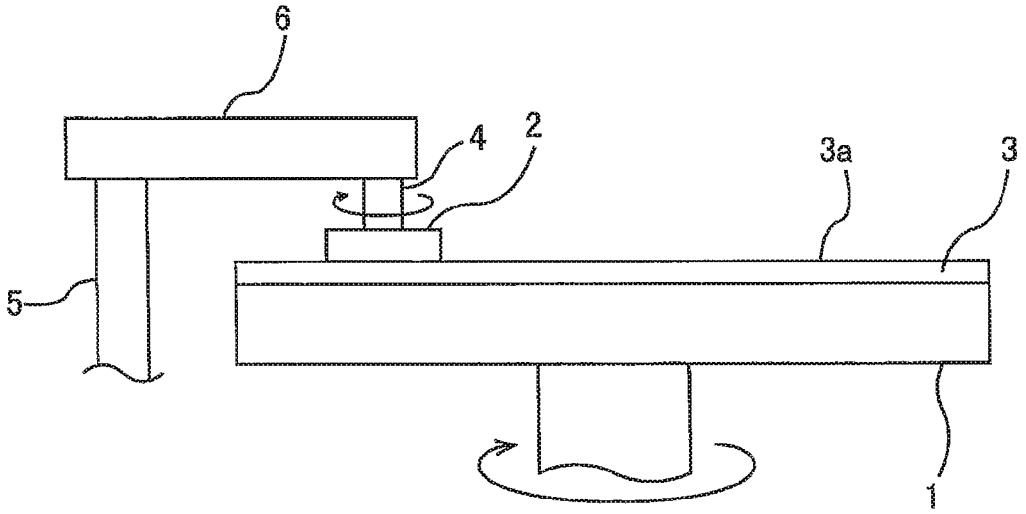
FIG. 1 PRIOR ART
FIG. 1 is a side view of a dresser when dressing a polishing pad on a polishing table.

Embodiments will be described below with reference to the drawings. In FIGS. 3 through 17, identical or corresponding components will be denoted by identical reference numerals, and repetitive descriptions thereof are omitted.

Figure 3:
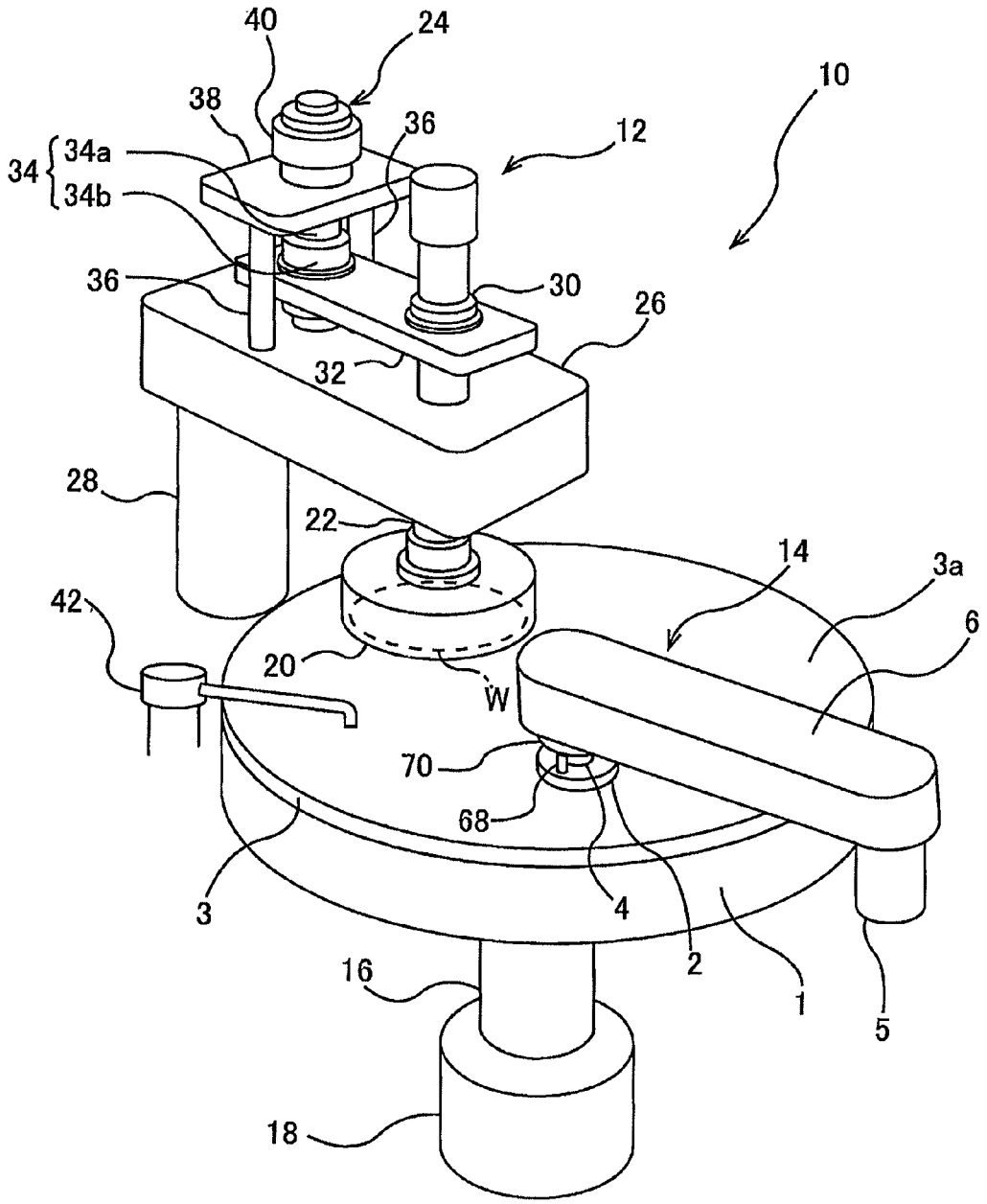
FIG. 3 is a schematic view of a polishing apparatus.

FIG. 3 is a schematic view of a polishing apparatus 10. As shown in FIG. 3, the polishing apparatus 10 has a polishing table 1 supporting a polishing pad 3 that serves as a polishing tool, a polishing head 12 for holding a substrate W, such as a wafer, and pressing the substrate W against the polishing pad 3 on the polishing table 1, and a dressing apparatus (a dressing unit) 14 for dressing a polishing surface 3*a* of the polishing pad 3. The polishing pad 3 is attached to the upper surface of the polishing table 1, and has an upper surface serving as the polishing surface 3*a* for polishing the substrate W. Instead of the polishing pad 3, fixed abrasive grains or a polishing cloth may be used as the polishing tool.

The polishing table 1 is coupled to a table motor 18 through a table shaft 16. The polishing table 1 and the polishing pad 3 are rotated about their axes by the table motor 18.

The polishing head 12 includes a top ring 20 for holding and pressing the substrate W against the polishing surface 3*a*, a top ring shaft 22 to which the top ring 20 is fixed, a top ring elevator 24 for elevating and lowering the top ring 20 through the top ring shaft 22, a top ring arm 26 to which the top ring elevator 24 is mounted, and a top ring rotating mechanism (not shown) for rotating the top ring 20 about its central axis through the top ring shaft 22. The top ring rotating mechanism is disposed in the top ring arm 26. The top ring elevator 24 and the top ring rotating mechanism constitute a top ring actuator for actuating the top ring 20.

The top ring 20 is coupled to a lower end of the top ring shaft 22. The top ring 20 is configured to hold the substrate W on its lower surface by vacuum suction. The top ring arm 26 is coupled to a top ring pivot shaft 28 so that the top ring arm 26 can pivot on the top ring shaft 28.

The top ring elevator 24 includes a bridge 32 having a bearing 30 mounted thereon for rotatably supporting the top ring shaft 22, a ball screw 34 mounted to the bridge 32, a support base 38 supported by support columns 36, and a servomotor 40 mounted to the support base 38. The support base 38 that supports the servomotor 40 is coupled to the top ring arm 26 through the support columns 36.

The ball screw 34 has a screw shaft 34*a* coupled to the servomotor 40 and a nut 34*b* that engages the screw shaft 34*a*. The top ring shaft 22 can be elevated and lowered (i.e., moved vertically) together with the bridge 32. When the servomotor 40 is energized, the ball screw 34 moves the bridge 32 in the vertical direction to move the top ring shaft 22 and the top ring 20 up and down.

Polishing of the substrate W is performed as follows. The top ring 20, holding the substrate W thereon, is moved from a retreat position to a polishing position. The top ring 20 and the polishing table 1 are rotated in the same direction, and a polishing liquid supply nozzle 42 supplies a polishing liquid (or slurry) onto the polishing pad 3. In this state, the top ring 20 presses the substrate W against the polishing surface 3*a* of the polishing pad 3, thereby providing sliding contact between the substrate W and the polishing surface 3*a*. The surface of the substrate W is polished by a chemical action of the polishing liquid and a mechanical action of abrasive grains that are contained in the polishing liquid.

The dressing apparatus 14 has a dresser 2 for dressing the polishing surface 3*a* of the polishing pad 3, a dresser shaft 4 to which the dresser 2 is coupled, a dresser arm 6 supporting the dresser shaft 4, and a dresser rotating mechanism (not shown in the drawings) for rotating the dresser 2 through the dresser shaft 4. The dresser rotating mechanism is disposed in the dresser arm 6. Abrasive grains (not shown in the drawings), such as diamond particles, are fixed to the lower surface of the dresser 2 to provide a dressing surface.

The dresser arm 6 is coupled to a dresser pivot shaft 5 so that the dresser arm 6 can pivot on the dresser pivot shaft 5. When the dresser arm 6 pivots, the dresser 2 oscillates on the polishing surface 3*a* in substantially the radial direction of the polishing table 1. While oscillating on the polishing surface 3*a* of the polishing pad 3, the dresser 2 rotates on the polishing surface 3*a* to scrape away the polishing pad 3 slightly, thereby dressing the polishing surface 3*a*.

Figure 4:
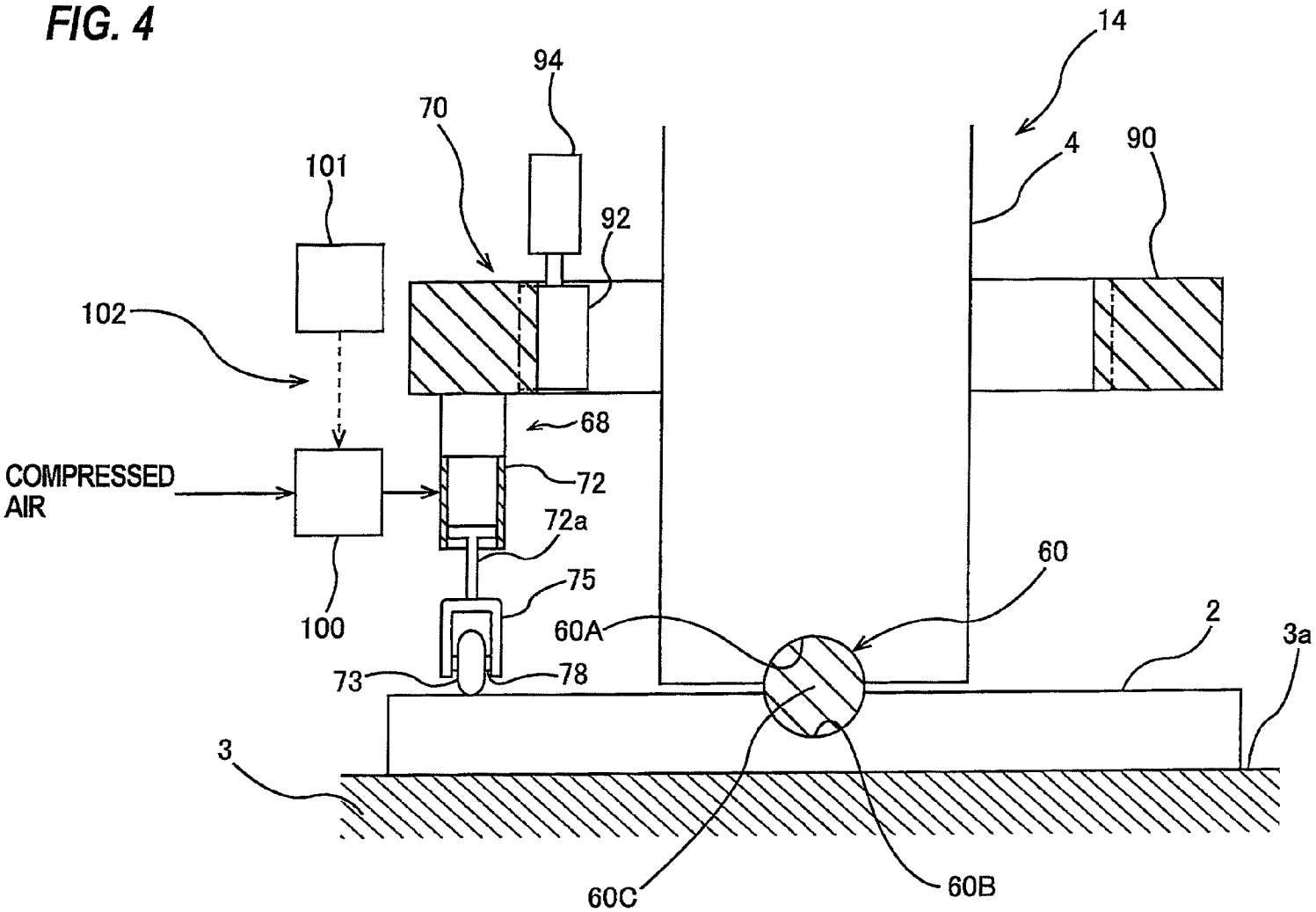
FIG. 4 is a cross-sectional view of a dressing apparatus according to an embodiment.

FIG. 4 is a cross-sectional view of a portion of the dressing apparatus 14 according to an embodiment. As shown in FIG. 4, the dresser 2 and the dresser shaft 4 are coupled to each other through a spherical bearing 60 interposed therebetween. The spherical bearing 60 is configured to permit the dresser 2 to tilt with respect to the dresser shaft 4, while transmitting a load of the dresser shaft 4 to the central portion of the dresser 2. This spherical bearing 60 has a spherical recess 60A defined in the lower surface of the dresser shaft 4, a spherical recess 60B defined in the upper surface of the dresser 2, and a ball 60C slidably held on the spherical recesses 60A, 60B. The ball 60C is made of a highly wear-resistant material, such as ceramic. The spherical recesses 60A, 60B and the ball 60C are arranged on the central axis of the dresser shaft 4.

The dressing apparatus 14 further includes a load-applying device 68 for applying a downward load to a part of the peripheral portion of the dresser 2, and a rotating mechanism 70 for supporting the load-applying device 68 and rotating the load-applying device 68. The load-applying device 68 and the rotating mechanism 70 are disposed radially outwardly of the dresser shaft 4. The rotating mechanism 70 is configured to rotate the load-applying device 68 around the dresser shaft 4 (i.e., around the center of the dresser 2).

The load-applying device 68 has a pneumatic cylinder 72 and a pressurizing roller 73 coupled to a piston rod 72*a* of the pneumatic cylinder 72. The pneumatic cylinder 72 is secured to the rotating mechanism 70 so that the pneumatic cylinder 72 is rotated around the dresser shaft 4 by the rotating mechanism 70. A roller support member 75 is mounted to a distal end of the piston rod 72*a*. The pressurizing roller 73 is rotatably supported by a roller shaft 78 that is disposed centrally in the pressurizing roller 73, and is rotatable about the roller shaft 78. The roller shaft 78 is fixed to the roller support member 75.

The pressurizing roller 73 is vertically movable by the pneumatic cylinder 72. The pneumatic cylinder 72 is coupled to an electropneumatic regulator (or a gas pressure regulator) 100 that regulates the pressure of compressed air supplied to the pneumatic cylinder 72. The electropneumatic regulator 100 is coupled to an air compressor (or a compressor), not shown. The air compressor supplies the compressed air through the electropneumatic regulator 100 to the pneumatic cylinder 72. The electropneumatic regulator 100 has a pressure regulating mechanism, not shown, which regulates the pressure of the compressed air supplied into the pneumatic cylinder 72.

When the pneumatic cylinder 72 is supplied with the compressed air, the piston rod 72*a* and the pressurizing roller 73 are lowered until the pressurizing roller 73 presses a part of the peripheral portion of the dresser 2 downwardly. The pressurizing roller 73 is placed in rolling contact with the upper surface of the dresser 2. The downward load applied to the dresser 2 is varied in accordance with the pressure of the compressed air supplied to the pneumatic cylinder 72. The electropneumatic regulator 100 is coupled to a controller 101. The controller 101 is configured to operate the electropneumatic regulator 100 to regulate the pressure of the compressed air supplied to the pneumatic cylinder 72, thereby controlling the downward load of the pressurizing roller 73. The controller 101 is further configured to control the rotating operation of the rotating mechanism 70.

The controller 101 operates the electropneumatic regulator 100 so as to supply the compressed air having a predetermined pressure into the pneumatic cylinder 72. The electropneumatic regulator 100 supplies the compressed air having the predetermined pressure to the pneumatic cylinder 72. In this embodiment, the controller 101 and the electropneumatic regulator 100 constitute an operation controller 102 which controls the operations of the load-applying device 68 and the rotating mechanism 70.

As shown in FIG. 4, the rotating mechanism 70 includes an annular ring gear 90 which is concentric with the dresser shaft 4, a pinion gear 92 for rotating the ring gear 90, and an actuator (e.g., a servomotor) 94 for actuating the pinion gear 92. The ring gear 90 and the pinion gear 92 are in mesh with each other. When the actuator 94 is set in motion, the pinion gear 92 is rotated, thereby rotating the ring gear 90 simultaneously. The ring gear 90 is rotatably supported by a support member, not shown, and the pneumatic cylinder 72 of the load-applying device 68 is fixed to the lower surface of the ring gear 90.

Figure 5:
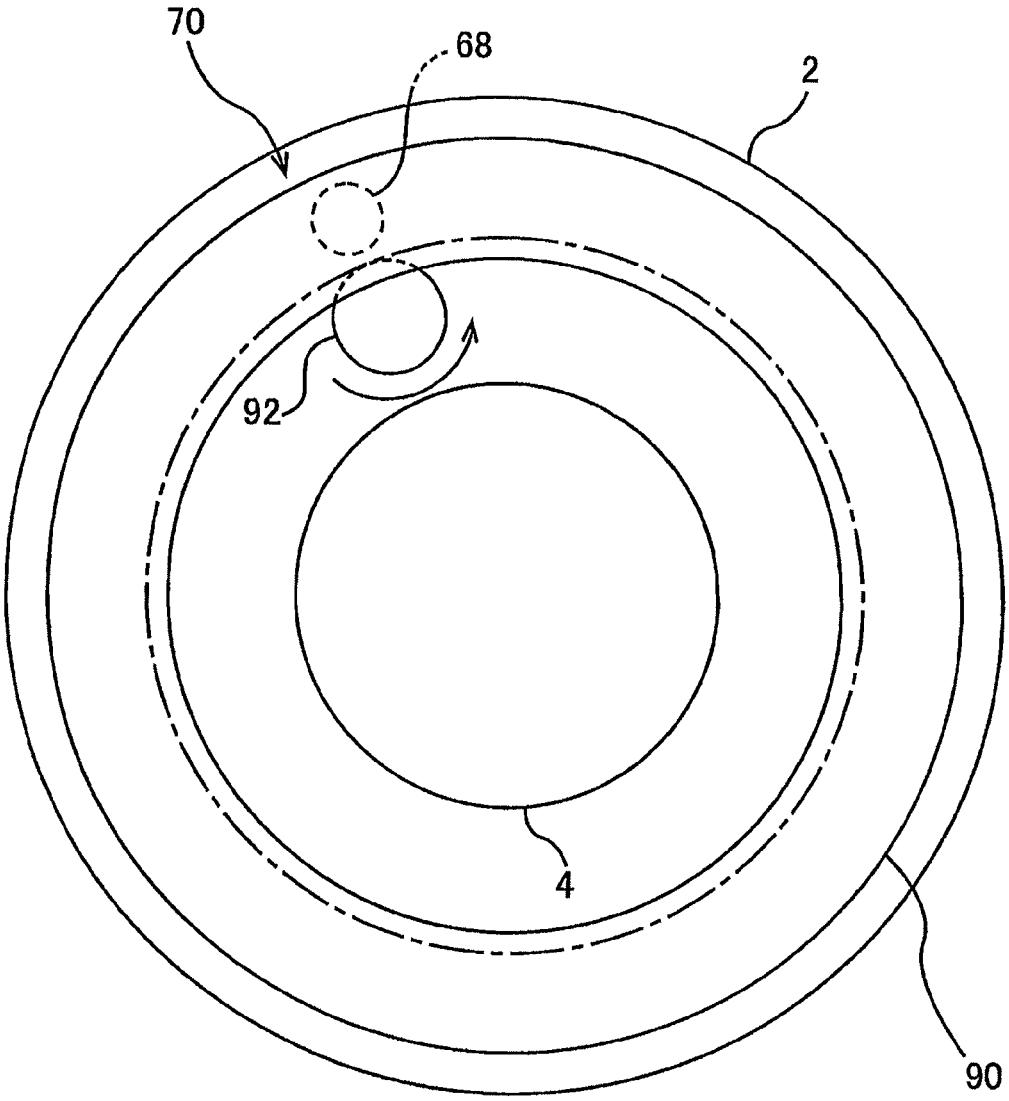
FIG. 5 is a plan view of a rotating mechanism.

FIG. 5 is a plan view of the rotating mechanism 70. When the pinion gear 92 rotates in a direction indicated by arrow, the ring gear 90 and the load-applying device 68 rotate around the dresser shaft 4. During pad dressing, the dresser 2 rotates about the dresser shaft 4, while the ring gear 90 does not rotate together with the dresser 2 because the ring gear 90 is supported by the support member (not shown) that is separated from the dresser 2. Therefore, the rotating mechanism 70 serves as a relatively moving mechanism for moving the load-applying device 68 relative to the dresser 2.

Figure 6A:
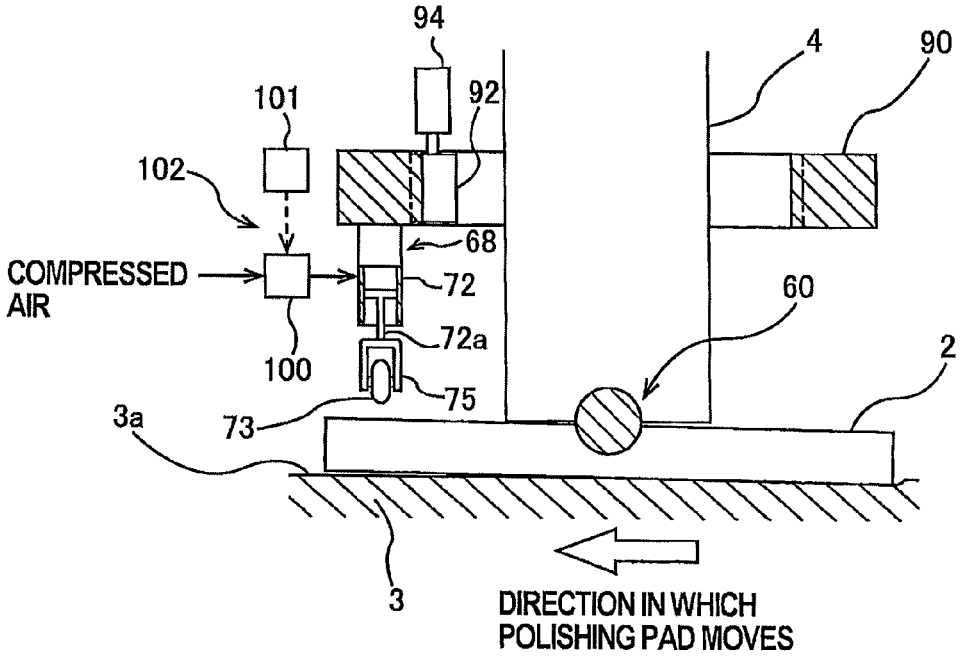
FIG. 6A is a view showing a state in which a dresser is tilted with respect to a polishing surface.
Figure 6B:
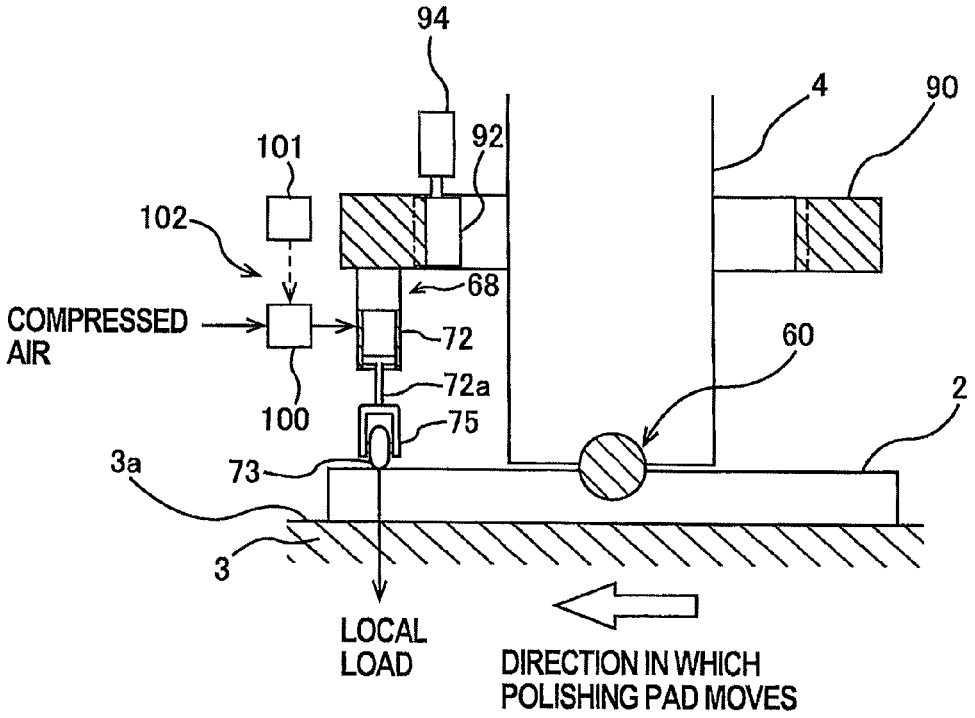
FIG. 6B is a view showing a state in which a pressurizing roller is lowered to apply a downward load to a part of the peripheral portion of the dresser.

When the dresser 2 is dressing the polishing pad 3, the dresser 2 is tilted due to the friction between the dresser 2 and the polishing pad 3, as shown in FIG. 6A. When dressing the polishing pad 3, the dresser 2 is tilted in such a manner that its upstream portion sinks into the polishing pad 3 while its downstream portion rises from the polishing pad 3. The dresser 2 thus tilted is unable to press its dressing surface uniformly against the polishing surface 3*a* of the polishing pad 3. Thus, the load-applying device 68 lowers the pressurizing roller 73 to apply the downward force locally to a part of the peripheral portion (i.e., the downstream portion) of the dresser 2, thus keeping the dressing surface of the dresser 2 parallel to the polishing surface 3*a* of the polishing pad 3. As a result, as shown in FIG. 6B, the overall dressing surface of the dresser 2 can uniformly rub against the polishing surface 3*a* of the polishing pad 3. As shown in FIG. 6A, the load-applying device 68 is located downstream of the dresser shaft 4 with respect to the moving direction of the polishing pad 3.

Figure 2:
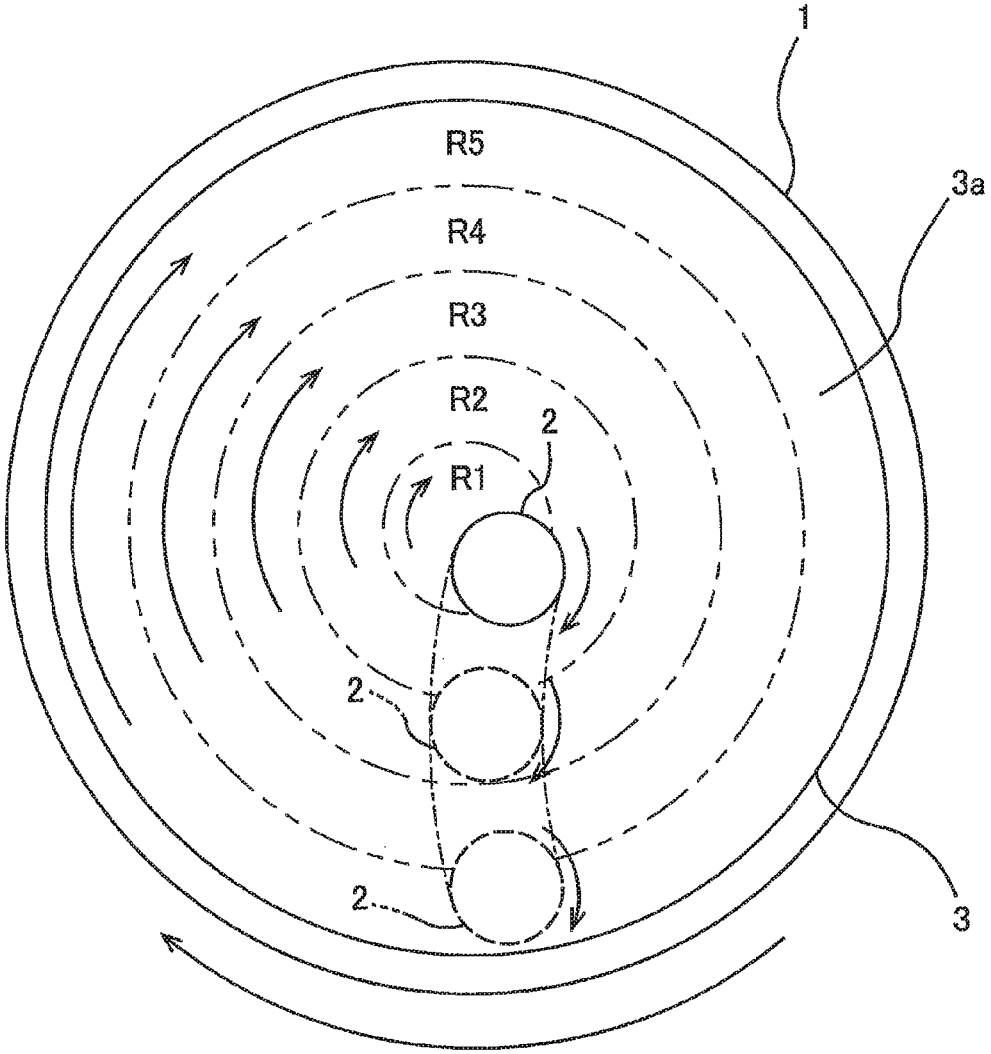
FIG. 2 PRIOR ART
FIG. 2 is a plan view showing relative movement between the polishing table and the dresser.

The dresser 2 dresses the polishing surface 3*a* of the polishing pad 3 while oscillating on the polishing pad 3 in substantially the radial direction of the polishing pad 3. As the dresser 2 approaches the center of the polishing pad 3, the velocity of the polishing pad 3 in the circumferential direction thereof decreases. Therefore, an angle of tilt of the dresser 2 (i.e., an angle of the dresser 2 with respect to the polishing surface 3*a*) varies in accordance with the position of the dresser 2. The operation controller 102 controls the load-applying device 68 so as to change the downward load applied to the dresser 2 in accordance with the position of the dresser 2 on the polishing pad 3. More specifically, the load-applying device 68 generates a greater load in a region where the dresser 2 is tilted greatly, while the load-applying device 68 generates a smaller load in a region where the dresser 2 is less tilted. Target values of the load are prepared respectively for the regions R1 through R5 (see FIG. 2) that are defined in advance on the polishing surface 3*a*. These target values are stored in advance in the controller 101 of the operation controller 102.

As the dresser 2 moves substantially radially on the polishing pad 3, a direction of a frictional force acting on the dresser 2 changes. Therefore, the direction in which the dresser 2 is tilted (or more specifically the direction in which the dresser 2 is tilted relative to the center of the polishing pad 3) changes depending on the position of the dresser 2 on the polishing surface 3*a*. In view of this, in the present embodiment, the rotating mechanism 70 is configured to move the load-applying device 68 relative to the rotating dresser 2 so as to keep up with the change in the direction in which the dresser 2 is tilted.

Figure 7:
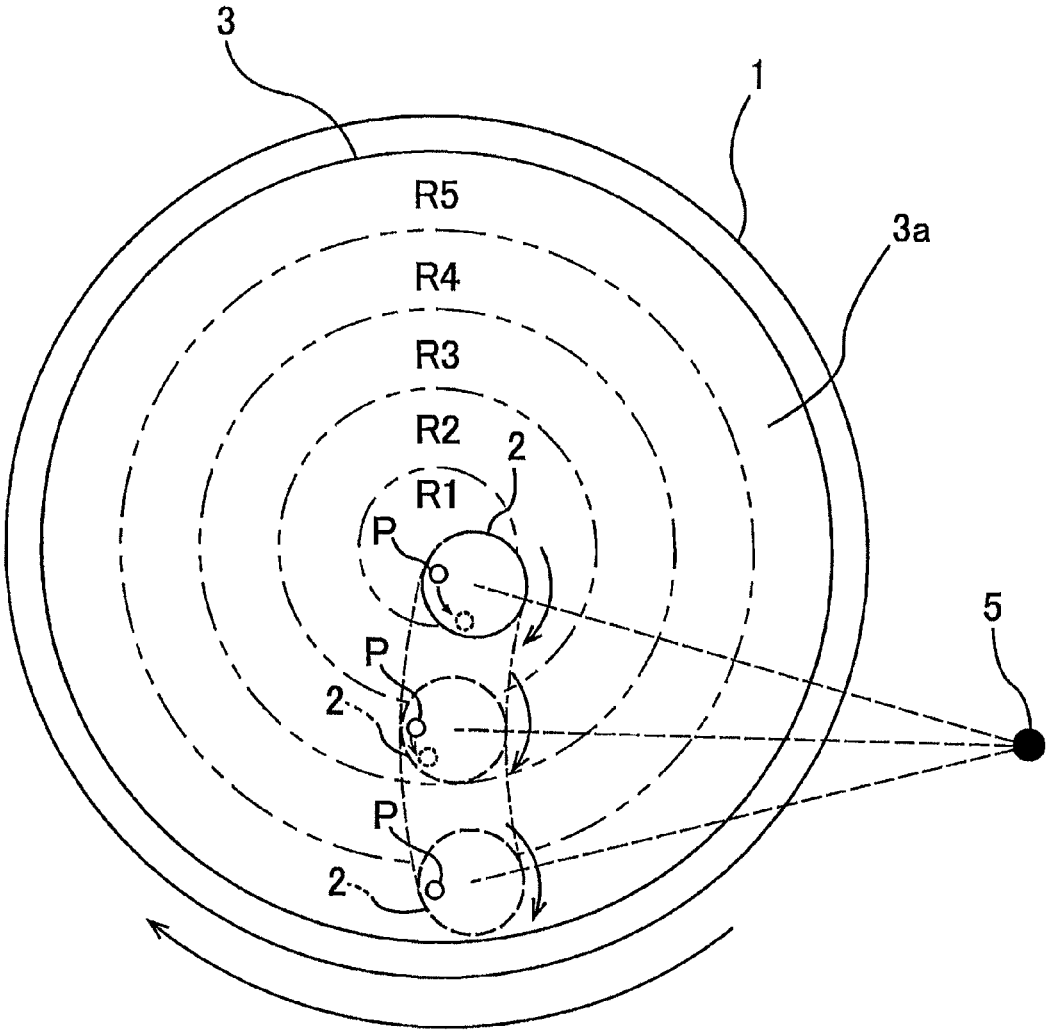
FIG. 7 is a plan view showing a manner in which a load point of a load-applying device is varied in accordance with a position of the dresser on a polishing pad.

FIG. 7 is a plan view showing a manner in which a load point P (the position of the pressurizing roller 73) of the load-applying device 68 is varied in accordance with the radial position of the dresser 2 on the polishing pad 3. As shown in FIG. 7, the rotating mechanism 70 changes the load point P of the load-applying device 68 (i.e., changes the position of the load-applying device 68 relative to the rotating dresser 2 in its entirety) by rotating the load-applying device 68 in accordance with the position of the dresser 2 on the polishing pad 3. Since the load-applying device 68 is rotated in accordance with the change in the direction in which the dresser 2 is tilted, the dresser 2 can be kept parallel to the polishing surface 3*a* regardless of the position of the dresser 2 when it is oscillating.

The load and the rotational angle of the load-applying device 68 that are required to keep the dresser 2 horizontal are predetermined by way of experimentation. The load and the rotational angle of the load-applying device 68 are predetermined for each of the regions predefined on the polishing surface 3*a*, and a dressing recipe as shown in FIG. 8 is created. FIG. 8 is a diagram showing an example of the dressing recipe. According to the example shown in FIG. 8, the polishing surface 3*a* of the polishing pad 3 is divided into five regions; the region R1 to the region R5 (see FIG. 7). A rotational speed of the dresser 2, a load (a dressing load) applied to the polishing surface 3*a*, the downward load (which may be hereinafter referred to as "local load") applied from the load-applying device 68 to the dresser 2, and the rotational angle of the load-applying device 68 are set for each of the regions.

The dressing recipe thus created is stored in the controller 101. The controller 101 operates the rotating mechanism 70 and the load-applying device 68 according to the dressing recipe. When the polishing pad 3 is being dressed, the rotating mechanism 70 rotates the load-applying device 68 by a predetermined angle, and the load-applying device 68 applies a predetermined downward load to a part of the peripheral portion (downstream portion) of the dresser 2.

The dresser 2 rotates while oscillating on the polishing surface 3*a* to slightly scrape away the polishing pad 3, thereby dressing the polishing surface 3*a*. During pad dressing, the controller 101 controls the operation of the dresser 2 in order for the dresser 2 to dress the polishing surface 3*a* according to the dressing recipe. Specifically, the controller 101 changes the rotational speed of the dresser 2, the dressing load, the local load applied to the dresser 2 (i.e., the angle of the dressing surface of the dresser 2 with respect to the polishing surface 3*a*), and the rotational angle of the load-applying device 68 (the position of the local load) in accordance with the position of the dresser 2 on the polishing pad 3. Since the attitude of the dresser 2 is controlled in this manner, the dresser 2, when dressing the polishing pad 3, can be kept parallel to the polishing surface 3*a* of the polishing pad 3. Therefore, the dresser 2 can uniformly dress the polishing surface 3*a* in its entirety.

A polishing method using the polishing apparatus 10 that incorporates the load-applying device 68 will be described below. First, while the polishing table 1 is being rotated, the polishing surface 3*a* of the polishing pad 3 is supplied with a dressing liquid, and the dresser 2 is placed in sliding contact with the polishing surface 3*a* while oscillating on the polishing surface 3*a* in the radial direction of the polishing surface 3*a*. As described above, as the dresser 2 moves across the regions R1 through R5 (see FIGS. 2 and 7) defined on the polishing pad 3, the angle at which the dresser 2 is tilted and the direction in which the dresser 2 is tilted are varied. Thus, the local load applied to the dresser 2 and the position of the local load are changed in accordance with the position of the dresser 2 on the polishing pad 3. As a result, the dresser 2 is kept parallel to the polishing surface 3*a* irrespective of the position of the dresser 2 when oscillating on the polishing pad 3. After the dresser 2 has dressed the polishing surface 3*a*, the top ring 20 that is holding the substrate W is moved from the retreat position to the polishing position. The top ring 20 and the polishing table 1 are rotated in the same direction, and the polishing liquid supply nozzle 42 supplies the polishing liquid (or the slurry) onto the polishing pad 3. The top ring 20 then presses the substrate W against the polishing surface 3*a* of the polishing pad 3, thus bringing the substrate W and the polishing surface 3*a* into sliding contact with each other to thereby polish the substrate W.

Figure 9:
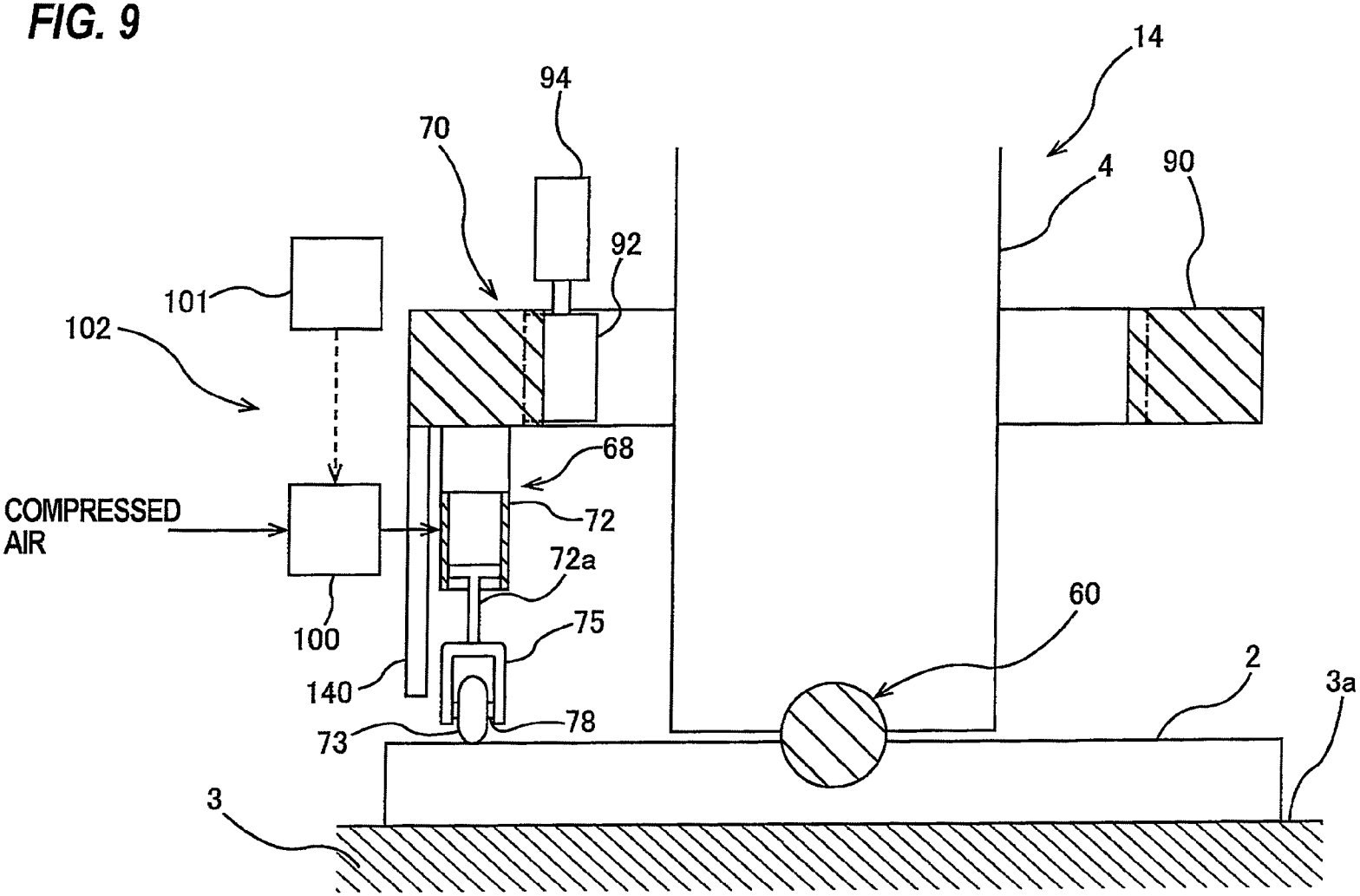
FIG. 9 is a view showing a dressing apparatus having a position sensor for detecting a height of the dresser.

As shown in FIG. 9, the dressing apparatus 14 may have a position sensor 140 for measuring the vertical position of the dresser 2, i.e., the height of the dresser 2, or more specifically the height of the upper surface of the dresser 2 from the polishing surface 3*a* of the polishing pad 3. The position sensor 140 is disposed adjacent to the load-applying device 68. The position sensor 140 is fixed to the lower surface of the ring gear 90, and is rotated together with the load-applying device 68 by the rotating mechanism 70. The position sensor 140 measures the height of the dresser 2, and sends the measured value of the height of the dresser 2 to the controller 101. The controller 101 controls the operation of the load-applying device 68 so as to maintain the measured value of the height of the dresser 2 at a predetermined target value. This predetermined target value is such that the dressing surface of the dresser 2 is kept parallel to the polishing surface 3*a*. In this embodiment, the local load applied from the load-applying device 68 to the dresser 2 is controlled based on the height of the dresser 2 that is fed back to the controller 101. Consequently, the local loads in the dressing recipe shown in FIG. 8 may be omitted.

Figure 10:
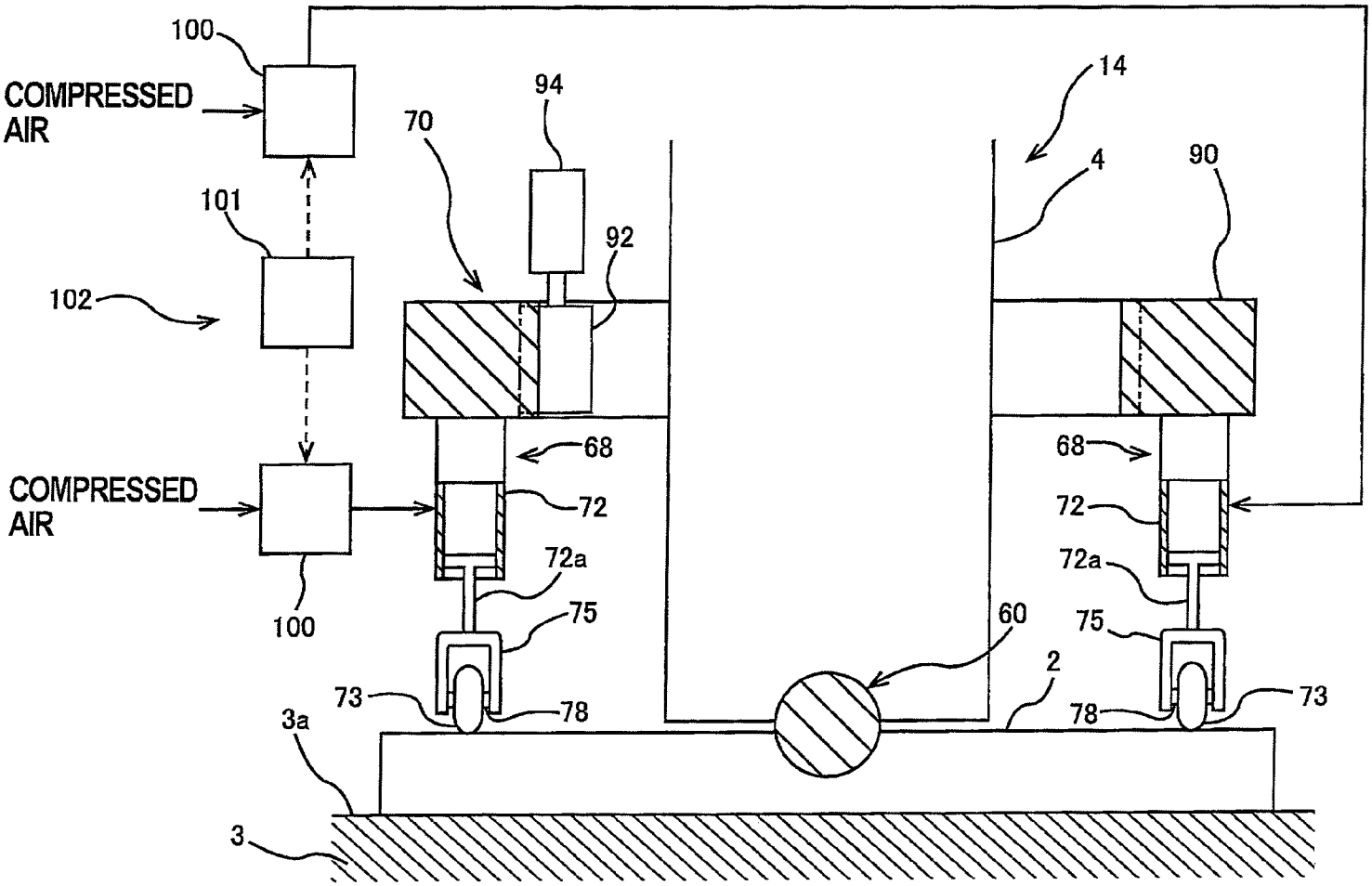
FIG. 10 is a view showing two load-applying devices mounted to a lower surface of the rotating mechanism.
Figure 11:
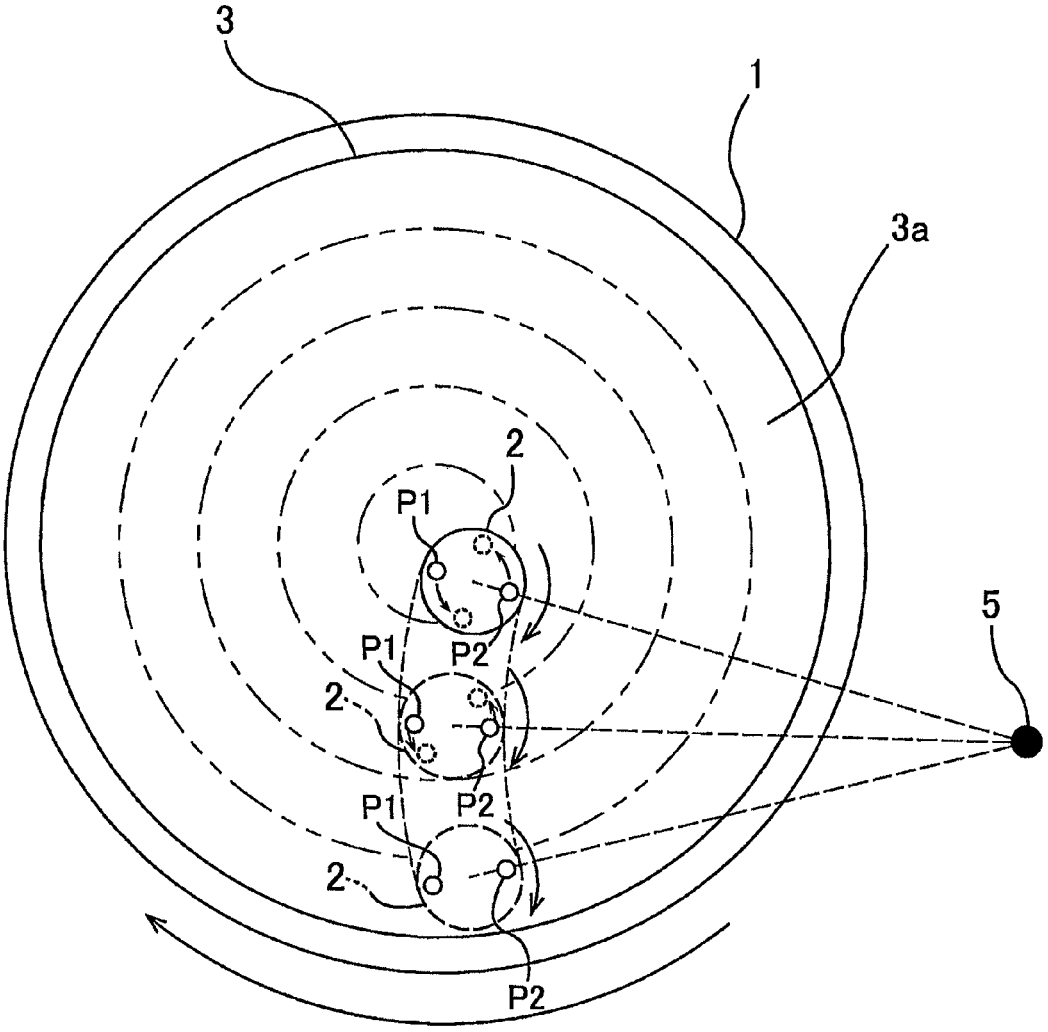
FIG. 11 is a schematic view showing a manner in which load points of the two load-applying devices are varied.

As shown in FIG. 10, two load-applying devices 68 may be mounted to the lower surface of the rotating mechanism 70. In this embodiment, the two load-applying devices 68 are disposed symmetrically about the dresser shaft 4. Specifically, the two load-applying devices 68 are arranged on a line (an imaginary line) interconnecting the center of the dresser 2 and the dresser pivot shaft 5. The operation controller 102 has two electropneumatic regulators 100 coupled respectively to the two load-applying devices 68 for individually controlling these two load-applying devices 68, so that the load-applying devices 68 can generate different loads. The two load-applying devices 68 have respective pneumatic cylinders 72 that are fixed to the lower surface of the ring gear 90. Therefore, the two load-applying devices 68 are rotated together with each other by the rotating mechanism 70. FIG. 11 is a schematic view showing a manner in which load points P1, P2 (the positions of the pressurizing rollers 73) of the two load-applying devices 68 are varied in accordance with the position of the dresser 2 on the polishing pad 3.

Figure 12:
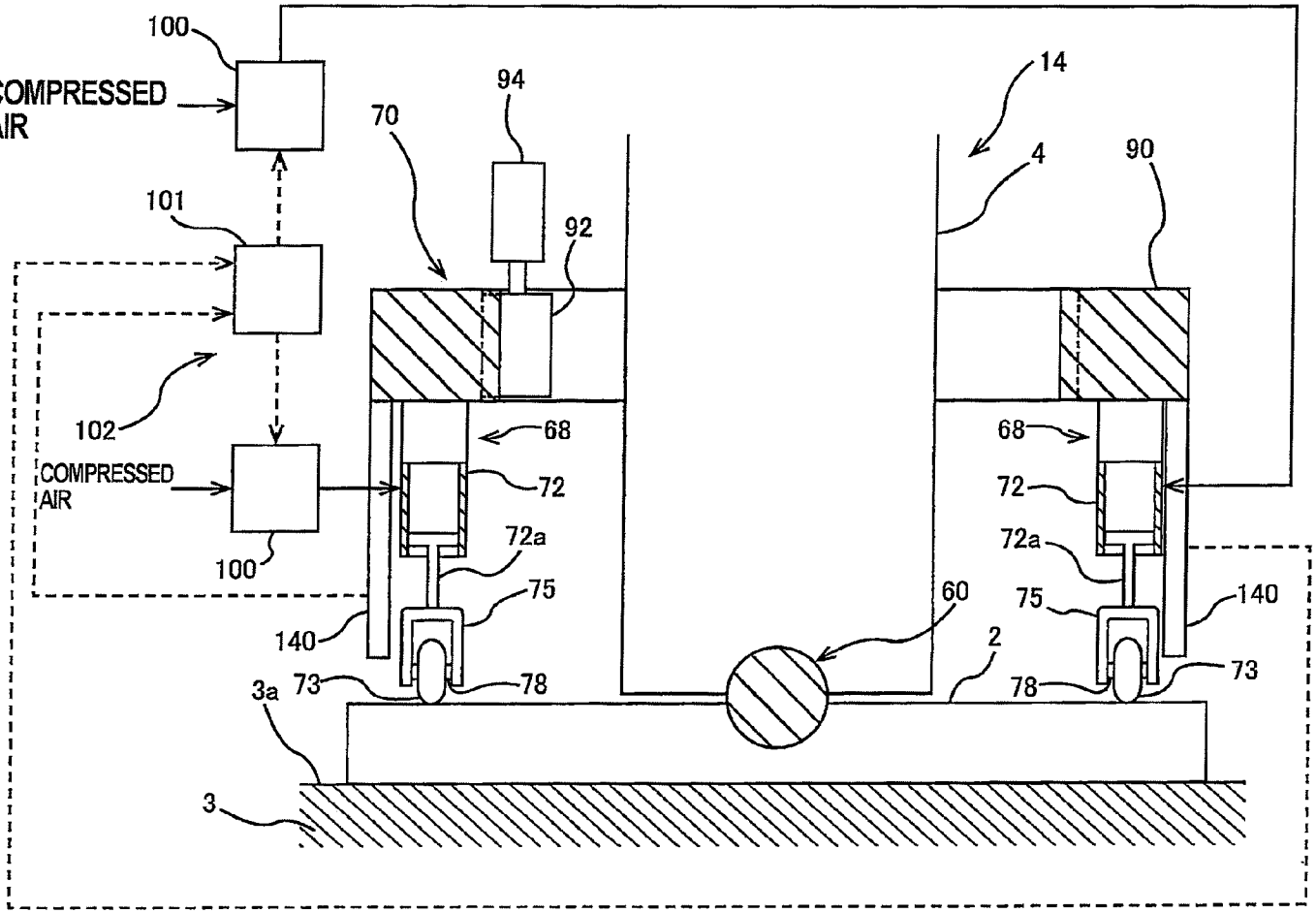
FIG. 12 is a view showing position sensors disposed adjacent to the two load-applying devices, respectively.

As shown in FIG. 12, two position sensors 140 may be disposed adjacent to the two load-applying devices 68, respectively. The operation controller 102 controls the operations of the two load-applying devices 68 such that the measured values of the height of the dresser 2 that are transmitted from the position sensors 140 are maintained at predetermined target values, respectively. The predetermined target values are such that the dressing surface of the dresser 2 can be kept parallel to the polishing surface 3*a*.

Figure 13:
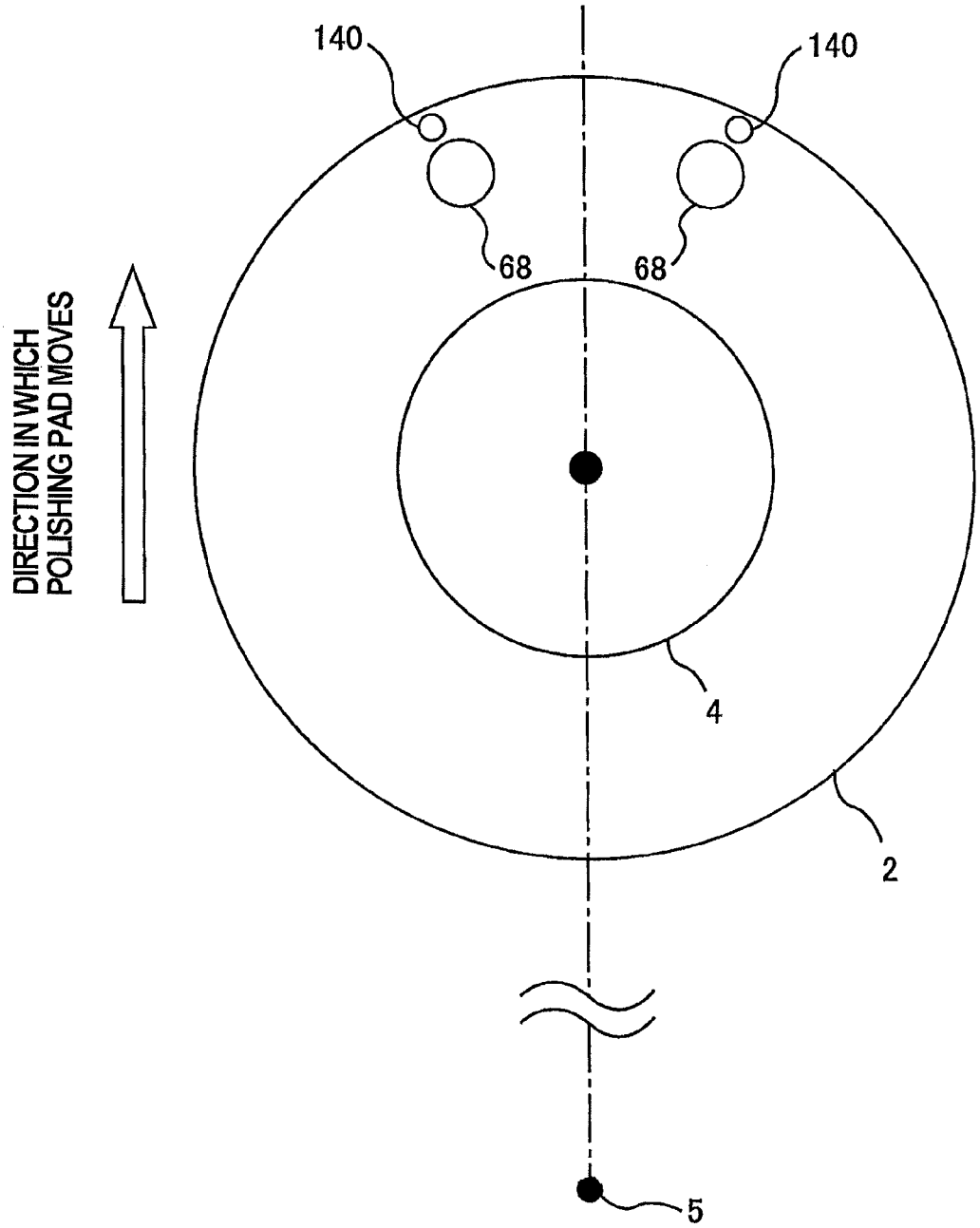
FIG. 13 is a plan view showing an arrangement of the two load-applying devices, the two position sensors, and the dresser.

FIG. 13 is a plan view showing an arrangement of the two load-applying devices 68, the two position sensors 140, and the dresser 2. As shown in FIG. 13, the two load-applying devices 68 may be disposed adjacent to each other, and the two position sensors 140 may be disposed adjacent to the two load-applying devices 68, respectively. In this embodiment, the two load-applying devices 68 are located downstream of the dresser shaft 4 and arranged on both sides of a line (an imaginary line) interconnecting the center of the dresser 2 and the dresser pivot shaft 5. The operation controller 102 controls the operations of the two load-applying devices 68 such that the measured values of the height of the dresser 2 that are transmitted from the position sensors 140 are maintained at predetermined target values, respectively. These predetermined target values are such that the dressing surface of the dresser 2 is kept parallel to the polishing surface 3*a*.

Figure 14:
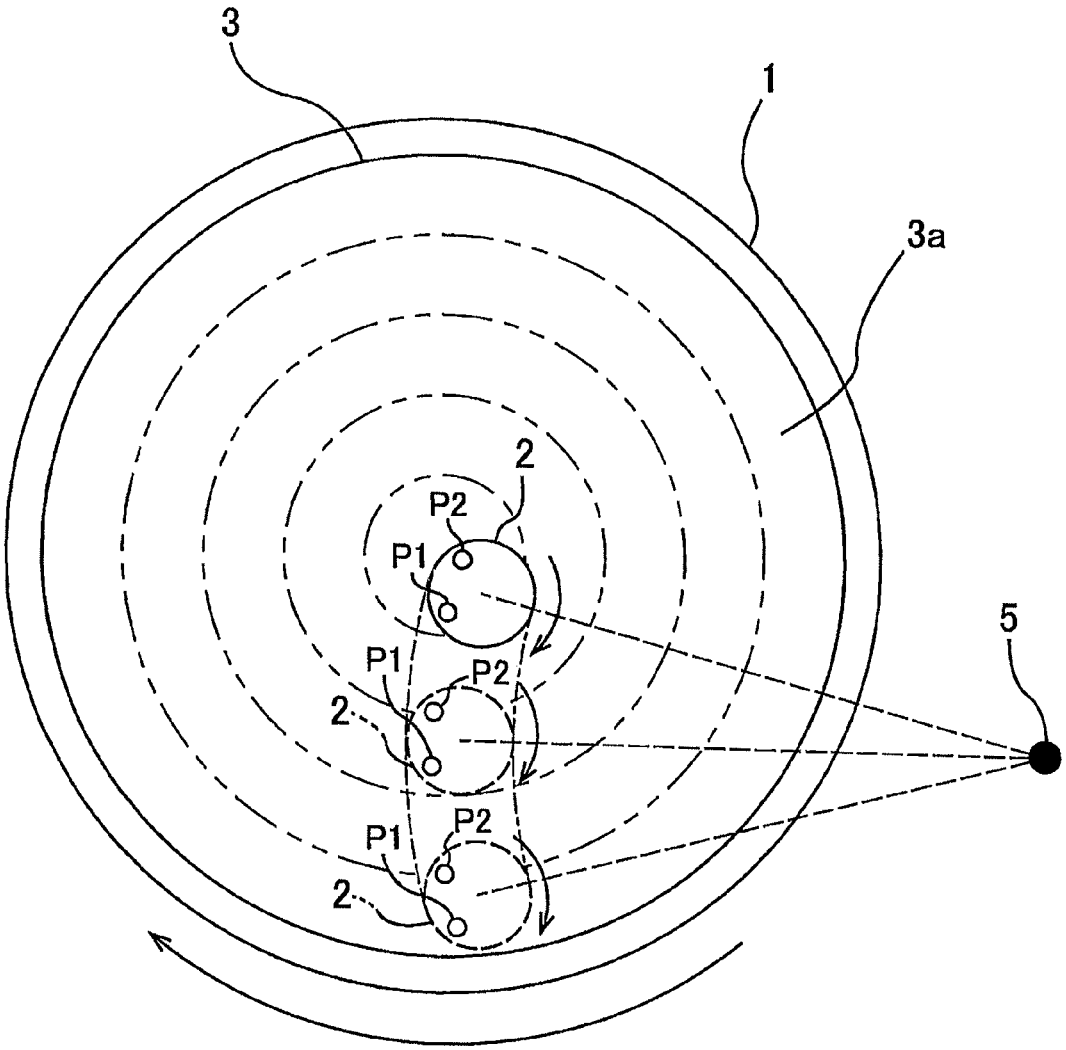
FIG. 14 is a plan view showing the load points of the two load-applying devices.

The local loads applied from the two load-applying devices 68 to the dresser 2 are controlled based on the height of the dresser 2 that is fed back to the controller. Therefore, according to the present embodiment, the local loads in the dressing recipe shown in FIG. 8 may be omitted. Furthermore, according to the embodiment shown in FIG. 13, even if the direction in which the dresser 2 is tilted is changed, the dresser 2 can be kept horizontally by changing a balance between the loads applied from the two load-applying devices 68. FIG. 14 is a plan view showing the load points P1, P2 (the positions of the pressurizing rollers 73) of the two load-applying devices 68. As shown in FIG. 14, the positions of the load points P1, P2 relative to the dresser 2 are constant regardless of the position of the dresser 2 when oscillating. The central position between the two loads can change in accordance with the change in the balance between the loads applied from the two load-applying devices 68. Therefore, the two load-applying devices 68 can keep the dresser 2 horizontal by following the changes in both the angle at which the dresser 2 is tilted and the direction in which the dresser 2 is tilted. In the present embodiment, the rotating mechanism 70 may be omitted.

Figure 15:
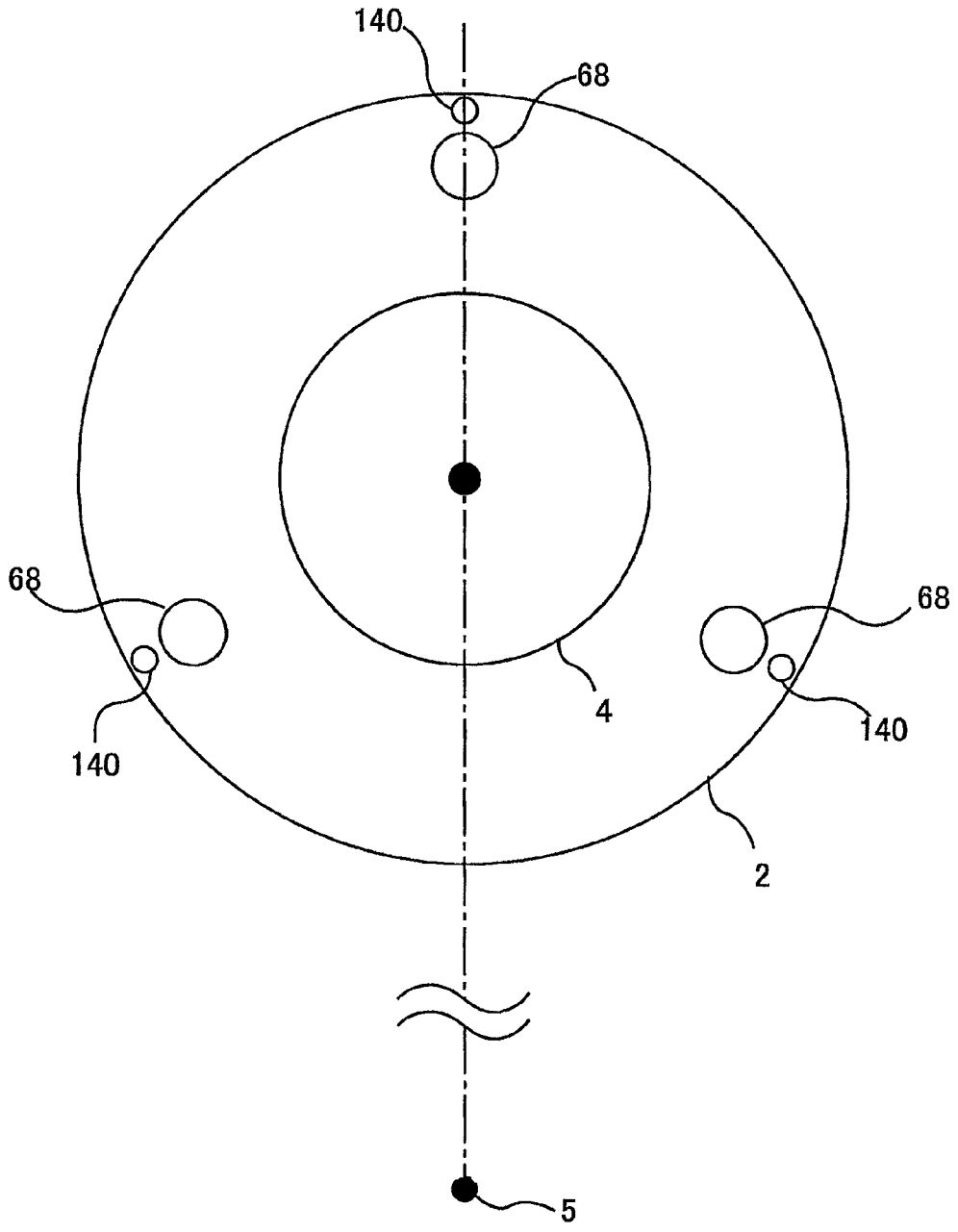
FIG. 15 is a plan view showing an arrangement of three load-applying devices, three position sensors, and the dresser.
Figure 16:
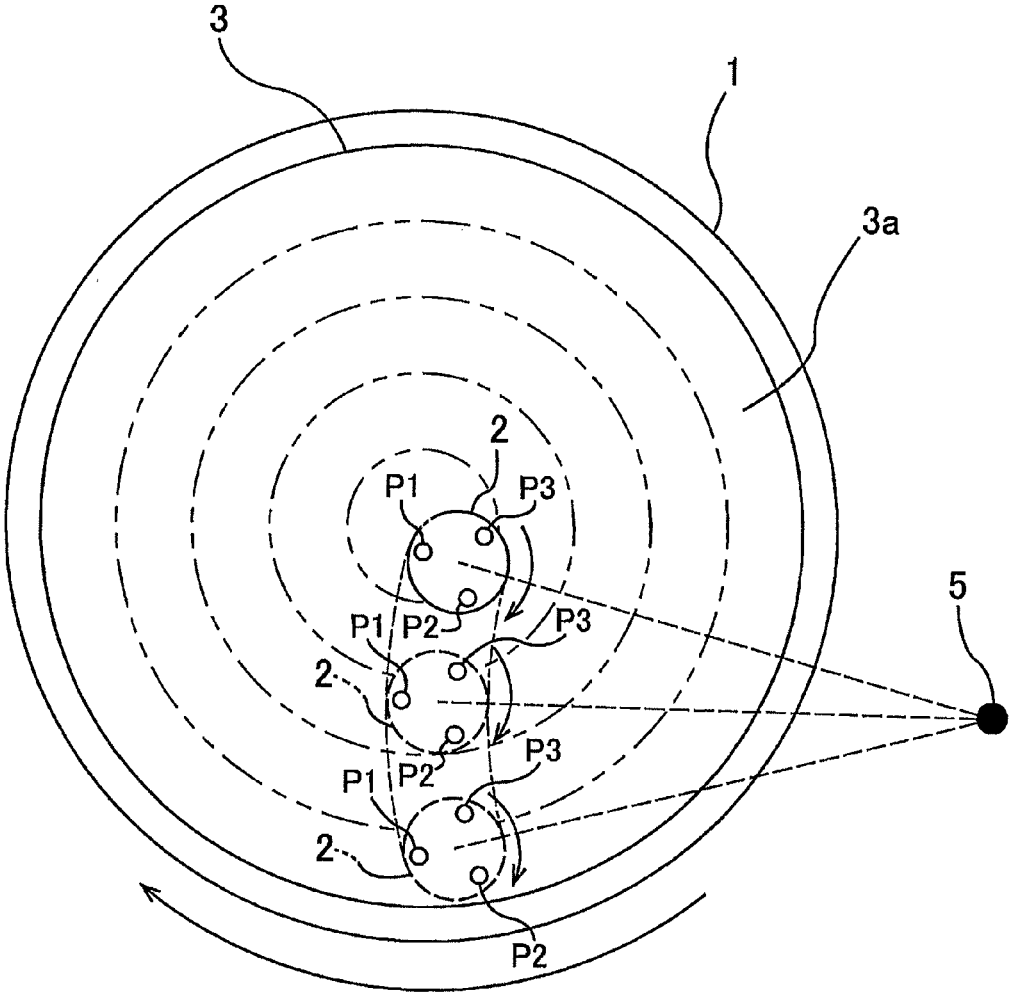
FIG. 16 is a plan view showing the load points of the three load-applying devices.

As shown in FIG. 15, three load-applying devices 68 and three position sensors 140 may be provided. The three load-applying devices 68 are arrayed at equal intervals around the dresser shaft 4. The three position sensors 140 are disposed adjacent to the three load-applying devices 68, respectively. FIG. 16 is a plan view showing load points P1, P2, P3 (i.e., positions of the pressurizing rollers 73) of the three load-applying devices 68. As shown in FIG. 15, the positions of the load points P1, P2, P3 relative to the dresser 2 are constant regardless of the position of the dresser 2 when oscillating. The central position between the three loads can change in accordance with the change in the balance between the loads applied from the three load-applying devices 68. Therefore, the three load-applying devices 68 can keep the dresser 2 horizontal by following the changes in both the angle at which the dresser 2 is tilted and the direction in which the dresser 2 is tilted. In the present embodiment, the rotating mechanism 70 may also be omitted. It is also possible to provide four or more load-applying devices 68 and four or more position sensors 140.

Figure 17:
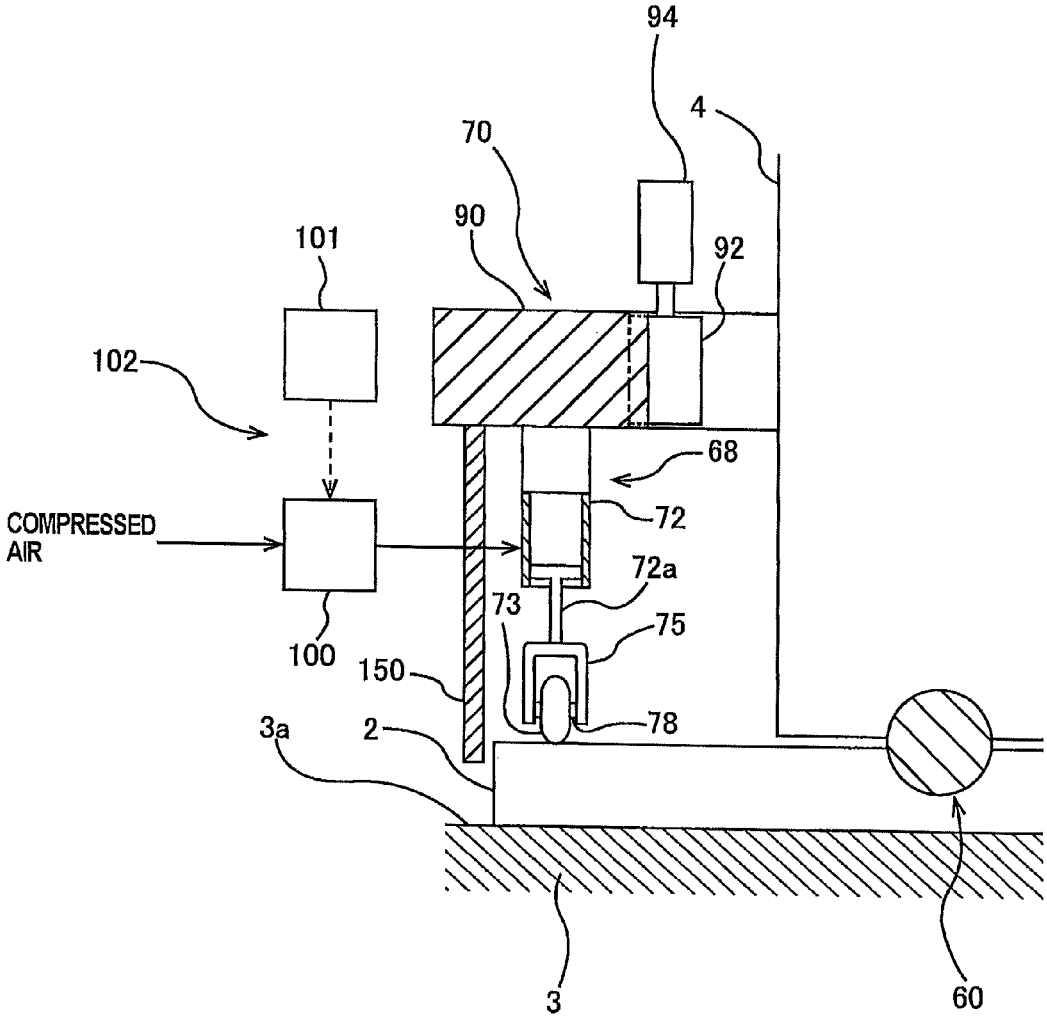
FIG. 17 is a view showing a dressing apparatus having a cylindrical cover.

As shown in FIG. 17, it is preferable to install a cylindrical cover 150 so as to surround the load-applying device 68 and an upper portion of the dresser 2. The cover 150 is fixed to the lower surface of the ring gear 90 and extends to a position below the pressurizing roller 73. The cover 150 can prevent droplets of the polishing liquid or the like from being attached to sliding components, such as the pressurizing roller 73, and can further prevent dust particles, which are produced from the pressurizing roller 73, from dropping onto the polishing surface 3*a*.

Although the embodiments of the present invention have been describe above, it should be noted that the present invention is not limited to the above embodiments, but may be reduced to practice in various different embodiments within the scope of the technical concept of the invention.

What is claimed is:

1. A dressing apparatus, comprising:

a dresser configured to rub against a polishing surface to dress the polishing surface that is used for polishing a substrate;

a dresser shaft that applies a load to the dresser;

at least one load-applying device configured to apply a downward load to a part of a peripheral portion of the dresser, the at least one load-applying device including:

at least one pressing member configured to press the dresser; and at least one pneumatic cylinder configured to move the pressing member vertically; and an operation controller configured to control operation of the at least one load-applying device, the operation controller including at least one gas pressure regulator configured to regulate a pressure of a compressed air supplied to the at least one pneumatic cylinder; and a relatively moving mechanism configured to move the load-applying device relative to the dresser, wherein the relatively moving mechanism comprises a rotating mechanism configured to rotate the load-applying device around the dresser shaft and wherein the rotating mechanism includes:

an annular ring gear being concentric with the dresser shaft; and a pinion gear being in mesh with the annular ring gear.

2. The dressing apparatus according to claim 1, wherein the operation controller is configured to control the operation of the load-applying device so as to change the downward load in accordance with a position of the dresser on the polishing surface.

3. The dressing apparatus according to claim 1, wherein the operation controller is configured to control operation of the relatively moving mechanism so as to change a position of the load-applying device relative to the dresser in accordance with a position of the dresser on the polishing surface.

4. The dressing apparatus according to claim 1, further comprising:

at least one position sensor configured to measure a height of the dresser, wherein the operation controller is configured to control operation of the load-applying device such that a measured value of the height of the dresser is maintained at a predetermined target value.

5. The dressing apparatus according to claim 1, wherein:

the at least one load-applying device comprises a plurality of load-applying devices;

the at least one pressing member comprises a plurality of pressing members;

the at least one pneumatic cylinder comprises a plurality of pneumatic cylinders coupled to the plurality of pressing members, respectively; and the at least one gas pressure regulator comprises a plurality of gas pressure regulators coupled to the plurality of pneumatic cylinders, respectively.

6. The dressing apparatus according to claim 5, wherein the operation controller is configured to operate the plurality of gas pressure regulators independently.

7. The dressing apparatus according to claim 5, wherein the plurality of load-applying devices are two load-applying devices, the two load-applying devices being arranged symmetrically about the dresser shaft.

8. The dressing apparatus according to claim 5, wherein the plurality of load-applying devices are two load-applying devices, the two load-applying devices being arranged adjacent to each other.

9. The dressing apparatus according to claim 5, wherein the plurality of load-applying devices are three load-applying devices, the three load-applying devices being arranged at equal intervals around the dresser shaft.

10. The dressing apparatus according to claim 1, wherein the rotating mechanism further includes:

an actuator coupled to the pinion gear and configured to rotate the pinion gear.

11. The dressing apparatus according to claim 1, wherein the at least one pneumatic cylinder is fixed to a lower surface of the annular ring gear.

12. A polishing apparatus for polishing a substrate by bringing the substrate into sliding contact with a polishing surface, the polishing apparatus comprising:

a top ring configured to press the substrate against the polishing surface; and a dressing apparatus configured to dress the polishing surface, the dressing apparatus including (i) a dresser configured to rub against the polishing surface to dress the polishing surface, (ii) a dresser shaft that applies a load to the dresser, (iii) at least one load-applying device configured to apply a downward load to a part of a peripheral portion of the dresser, the at least one load-applying device including:

at least one pressing member configured to press the dresser; and at least one pneumatic cylinder configured to move the pressing member vertically, and (iv) an operation controller configured to control operation of the load-applying device, the operation controller including at least one gas pressure regulator configured to regulate a pressure of a compressed air supplied to the at least one pneumatic cylinder; and a relatively moving mechanism configured to move the load-applying device relative to the dresser, wherein the relatively moving mechanism comprises a rotating mechanism configured to rotate the load-applying device around the dresser shaft and wherein the rotating mechanism includes:

an annular ring gear being concentric with the dresser shaft; and a pinion gear being in mesh with the annular ring gear.

13. The polishing apparatus according to claim 12, wherein the operation controller is configured to control the operation of the load-applying device so as to change the downward load in accordance with a position of the dresser on the polishing surface.

14. The polishing apparatus according to claim 12, wherein the operation controller is configured to control operation of the relatively moving mechanism so as to change a position of the load-applying device relative to the dresser in accordance with a position of the dresser on the polishing surface.

15. The polishing apparatus according to claim 12, further comprising:

at least one position sensor configured to measure a height of the dresser, wherein the operation controller is configured to control operation of the load-applying device such that a measured value of the height of the dresser is maintained at a predetermined target value.

16. A dressing apparatus comprising:

a dresser configured to rub against a polishing surface to dress the polishing surface that is used for polishing a substrate;

a dresser shaft configured to apply a load to the dresser and rotate the dresser about its own axis;

at least one load-applying device configured to apply a downward load to a part of a peripheral portion of the dresser;

an operation controller configured to control operation of the load-applying device; and a rotating mechanism configured to rotate the load-applying device around the dresser shaft and relative to the dresser shaft, wherein the rotating mechanism includes:

an annular ring gear being concentric with the dresser shaft; and a pinion gear being in mesh with the annular ring gear.

17. The dressing apparatus according to claim 16, wherein the at least one load-applying device comprises a plurality of load-applying devices.

18. The dressing apparatus according to claim 16, wherein the rotating mechanism further includes:

an actuator coupled to the pinion gear and configured to rotate the pinion gear.

19. The dressing apparatus according to claim 18, wherein the at least one load-applying device is fixed to a lower surface of the annular ring gear.

20. The dressing apparatus according to claim 16, wherein the operation controller is configured to instruct the at least one load-applying device to change the downward load in accordance with a position of the dresser on the polishing surface.

21. The dressing apparatus according to claim 16, further comprising:

at least one position sensor configured to measure a height of the dresser, wherein the operation controller is configured to control operation of the load-applying device such that a measured value of the height of the dresser is maintained at a predetermined target value.

* * * * *